United States Patent [19]

Kucera

[11] 4,308,637

[45] Jan. 5, 1982

[54] SHOWER CURTAIN HANGER

[75] Inventor: Robert D. Kucera, Barrington, Ill.

[73] Assignee: Artway Manufacturing Co., Inc., Chicago, Ill.

[21] Appl. No.: 745,618

[22] Filed: Nov. 29, 1976

[51] Int. Cl.[3] ..... E05D 13/02

[52] U.S. Cl. ..... 16/93 D

[58] Field of Search ..... 16/87 R, 87.2, 93, 93 D; 24/73 AS, 73 CH, 73 PF, 84 H, 86 R

[56] References Cited

U.S. PATENT DOCUMENTS

| | | | |
|---|---|---|---|
| 437,279 | 9/1890 | Berbecker | 16/87.2 |
| 1,034,630 | 8/1912 | Laun | 16/87.2 |
| 2,320,308 | 5/1943 | Silverman | 16/87.2 |
| 3,629,912 | 12/1971 | Klopp | 24/84 H X |
| 3,737,943 | 6/1973 | Store | 16/87.2 |
| 3,772,734 | 11/1973 | Kimel | 16/87.2 |
| 4,010,503 | 3/1977 | Denton | 16/87.2 |

FOREIGN PATENT DOCUMENTS

| | | | |
|---|---|---|---|
| 1907384 | 9/1970 | Fed. Rep. of Germany | 16/87.2 |
| 10478 | of 1898 | United Kingdom | 16/87.2 |

*Primary Examiner*—Werner H. Schroeder
*Attorney, Agent, or Firm*—Alter and Weiss

[57] ABSTRACT

A unitary shower-curtain hanger in the form of a resilient elongated torus, interrupted at one point on its circumference. Mounting of a shower curtain thereon is accomplished by applying force to the hanger at the site of the interruption to deform the hanger sufficiently to allow a shower curtain eyelet to be slipped thereon and to enable placement of the hanger about a curtain rod. Thereafter, the hanger resiliently returns to its original closed configuration. Closure means located at the interruption of the hanger are then utilized to form a continuous elongated torus.

6 Claims, 4 Drawing Figures

SHOWER CURTAIN HANGER

BACKGROUND OF THE INVENTION

This invention relates to accessories for hanging shower curtains on shower rods and more particularly to a unitary shower curtain hanger which requires a minimum of manipulation to utilize..

Shower curtain hangers are required to mount plastic shower curtains and shower curtain liners on shower curtain rods which, in essence, covert a bathtub into a shower stall by providing a water impermeable shield extending above the upper rim of the bathtub. Ideally, such hangers should be easy to install and should securely hold the shower curtain in place, while still allowing for removal of the curtain or its liner for cleaning, or during redecorating.

Presently available shower curtain hangers may accomplish one or the other of these objectives but do not satisfy both. Generally, the easier it is to mount the shower curtain and liner on the hanger, the more likely it is that the curtain will accidentally become dislodged, which could result in water damage to the bathroom.

Conversely, hangers which firmly grip the shower curtain and the liner quite often require an appreciable amount of effort in order to be removed. This frequently results in hazardous maneuvers, such as standing on the rim of the bathtub while attempting to manipulate the shower curtain hangers.

One form of shower curtain hanger which has become popular is generally described as having two ends with a hook at either end. At one end the hook is sized and shaped to accommodate the shower curtain rod, while at the other end, the hook is sized and shaped to accommodate the grommet found in the beading of a shower curtain. Such hooks are open and have no closure means to maintain the hook on the rod, or the curtain on the hook, once in place. Typically, these hangers are fashioned from styrene, a non-flexible plastic which may crack when stressed. Other versions of this staple of lavatory commerce feature hangers shaped at the top to fit around the curtain rod, with the bottom portion being a snap-and-eye configuration which is inserted through the shower curtain grommet. In order to utilize such devices, mating ends of the hanger are deformed apart a sufficient distance to allow insertion over the curtain rod. The ends of the hanger must be laterally deformed a sufficient distance for the snap to be positioned at the edge of a track on the side of the hanger. While such a device securely holds the curtain on the rod, the limitations of the snap-and-eye configuration result in a considerable effort and torque exertion being required to laterally pry apart the hanger for mounting or removal of the curtain.

This invention has, therefore, as an object the provision of shower curtain hangers in a form through which shower curtains may be easily mounted.

A second object is to provide such hangers in forms which resist cracking and breaking.

A third object is to provide such hangers in forms easily operable and manipulatable to insert or remove shower curtains; and to provide such hangers in decorative and appealingly styled forms.

These and other objects of the invention will become apparent in view of the present Specification.

SUMMARY OF THE INVENTION

The present invention is a hanger for supporting shower curtains when the shower curtains are suspended from shower curtain rods. The invention comprises an elongated torus or doughnut shaped member which has an inside diameter large enough to encircle the curtain rod. At one point on this elongated torus member there is an interruption, so that the elongated torus resembles a substantially closed inverted U-shaped member. The elongated torus member is constructed of a material sufficiently elastic to allow the deformation of this interruption a sufficient distance so that the hanger can be slipped onto the shower curtain rod. The hanger then regains its original shape. After the hanger is slipped over the shower curtain rod, a locking device located at the interruption is slipped through grommets in the shower curtain and closed, thus forming a continuous elongated torus member.

In a preferred embodiment of the invention, this interruption in the elongated torus member is located at the elongated bottom end of the shower curtain hanger, so as to make it easier to place the hanger around the shower curtain rod and to mount the shower curtain on the hanger. The interior surface of the hanger has a smooth finish which makes it easier to slide the hanger along the curtain rod when mounting or using the hanger. This smooth surface also prevents the wearing away of the polished surface of the shower curtain rod and with it the accumulation of this worn surface on the shower curtain hanger.

Because one of the objects of the invention is to provide a shower curtain hanger which resists cracking and breaking, the invention is constructed out of a material which has a tensile strength greater than the tear strength of the materials commonly used in making shower curtains. If the user were to exert a sufficient pulling force on the shower curtain, the curtain would tear before the shower curtain hanger would break.

A series of grommets runs along the beading of the shower curtain. Several methods are provided for locking the shower curtain hanger through the shower curtain and on the shower curtain rod by means of these grommets. In one embodiment of the invention, the means for locking the hanger through the shower curtain comprises a post member located at the interruption of the torus member, extending from one end of the torus member towards the second end of the torus member. The second end of the torus member has a cavity for receiving the post member. The post member has a tip of substantially the same shape as the cavity but slightly larger than the opening of the cavity. The tip and post member are designed to be telescopically received by the opening, but with an interference fit, so as to restrain the post member within the cavity. The material for the construction of the hanger is sufficiently elastic to enable the snapping in of the tip of the post member past the opening into the cavity.

In yet another embodiment of the invention, the locking means comprise rounded tips on the ends of the elongated torous member at the interruption. The space between the ends of the torus member is so small as to constitute a substantially continuous torus member. The purpose of having so small a space is that when the torus member is deformed around the shower curtain rod, and then returned to its original shape, the hanger cannot be pulled off the shower curtain rod without substantially deforming the hanger.

The locking means previously mentioned also provides means for suspending the shower curtain itself. In one embodiment of the invention, the post member extending from the first end of the elongated torus member has a diameter smaller than the inside diameter of the grommets commonly used in the manufacture of shower curtains. When such post members are inserted through the grommets of the shower curtain, the shower curtain may thereby be vertically supported. The larger diameter of the elongated torus restrains the shower curtain's position by acting as shoulders to prevent the lateral movement of the shower curtain. In yet another embodiment of the invention, the rounded tips of the elongated torus member at the interruption are so close together that when the hanger is closed, the grommets of the shower curtain are suspended between the rounded tips of the elongated torus member. Thus, little deformation is required to remove the shower curtain, and yet the curtain is held firmly in place when the hanger is closed.

DETAILED DESCRIPTION OF THE DRAWINGS

Figure 1:
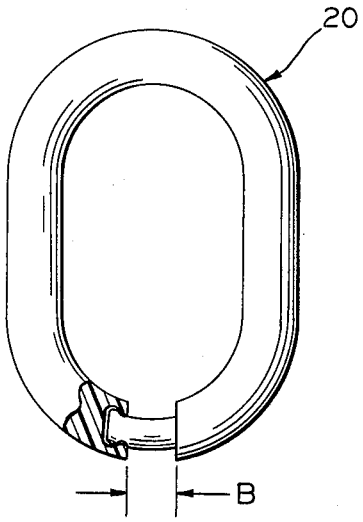
FIG. 1 is a front plan view of the inventive hanger.

As shown in the drawings, the numeral 20 indicates, generally, a shower curtain hanger in the form of an elongated torus interrupted at tis circumference at channel B. Hanger 20 may be deformed at channel B to allow insertion of rod 23 and shower curtain 24. Shower curtain hanger 20 may be conveniently molded from flexible resilient plastic, and may also be furnished in a wide variety of colors, including translucent, transparent, or opaque appearances, as desired.

Figure 2:
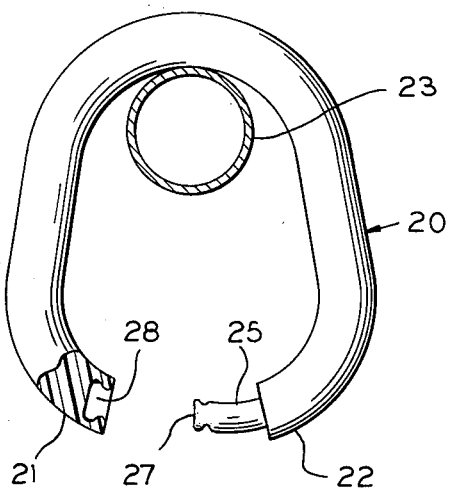
FIG. 2 is a front cut-away view of the hanger as installed on a shower curtain rod, with a portion of its periphery deformed to allow insertion on the shower curtian rod.
Figure 3:
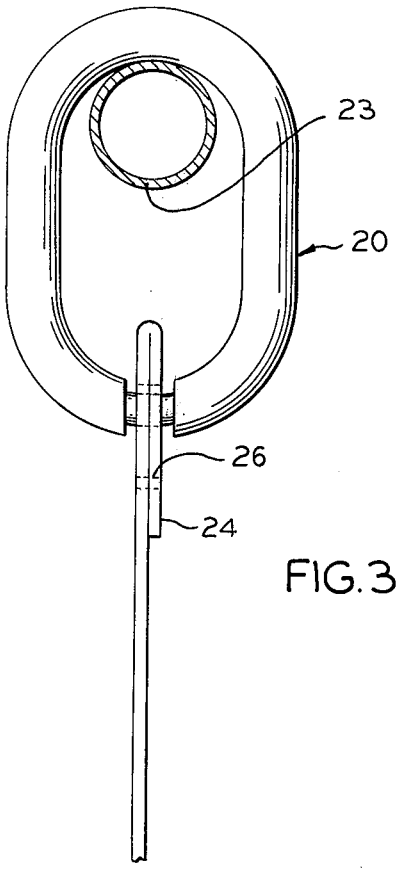
FIG. 3 is a plan view of the curtain as installed.

As illustrated in FIG. 2, hanger segments 21 and 22 are deformed outwardly to allow hanger 20 to be placed about shower curtain rod 23. Segments 21 and 22 may then be released and will resiliently regain their original closed shape. As illustrated in FIG. 3, to mount shower curtain 24 to hanger 20, hanger segments 21 and 22 may be deformed outwardly. In this position, post member 25, shown previously in FIG. 2 may be passed through eyelet 26 of shower curtain 24, and hanger segments 21 and 22 then released, thereby resiliently regaining their original configuration. The tip 27 of post member 25 is then inserted into the opening in cavity 28, where it is fixedly restrained by an interference fit, thereby forming shower curtain hanger 20 into a continuous elongated torus member.

Figure 4:
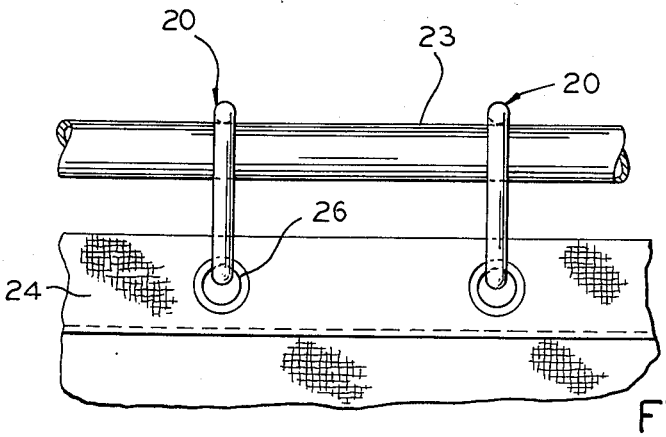
FIG. 4 is a perspective view of the completed shower curtain installation.

As further illustrated in FIG. 3, hanger 20 with shower curtain 24 installed thereon, forms a closed configuration about shower curtain rod 23. In this manner, shower curtain 24 is held firmly, yet may be easily removed as required. FIG. 4 illustrates a completed shower curtain installation as seen from the inside of the curtain.

While the foregoing is presented as a specific embodiment of the invention, it is to be understood that this embodiment is presented by way of example only. It is expected that others skilled in the art may perceive variations which while departing from the foregoing, are within the spirit and scope of the invention.

What is claimed is:

1. A one-piece hanger apparatus for suspending shower curtains below a horizontal rod member, said apparatus comprising:

an elongated torus member formed in a continuous geometric shape having an inside diameter sufficient in size so as to encircle said horizontal rod member, said elongated torus member having incorporated therewithin said geometric shape an interruption at which a first end of said torus member meets a second end of said torus member, said elongated torus member being constructed of a material substantially elastic to allow the deformation of said elongated torus member at said interruption to a distance greater than the diameter of said horizontal rod member, and having resilience to regain its original continuous geometric shape;

locking closure means located at said interruption, said locking closure means comprising a post member emanating from said first end of said torus member and a cavity axially located within said second end of said torus member, said post member capable of being alternatively fixedly received by said cavity and releasable therefrom, and said post member of said locking closure means being insertable through a grommet of said shower curtain so as to support said shower curtain therefrom.

2. The invention according to claim 1 in which said interruption of said elongated torus member is located at an elongated end of said elongated torus member to in turn facilitate placement of said torus member about said rod member, and to facilitate placement of said torus member through a shower curtain eyelet.

3. The invention according to claim 1 in which said elongated torus member has an interior surface with a sufficiently low coefficient of friction to enable free movement of said elongated torus member when encircling said horizontal rod member, along said horizontal rod member, said interior surface also being sufficiently smooth so as to prevent the erosion of the exterior of said horizontal rod member from friction of said elongated torus member when said elongated torus member is slid along said horizontal rod member.

4. The invention according to claim 1 in which said hanger for shower curtains is constructed of a material having a tensile strength greater than the tear strength of said shower curtains.

5. The invention according to claim 1 in which said post member has a tip of substantially corresponding shape to said cavity, so as to enable telescopic receipt of said tip of said post member by said cavity of said second end, said tip of said post member being slightly larger than the opening of said cavity so as to fixedly restrain said post member within the opening in said cavity when telescopically received therein, said material for the construction of said elongated torus member being sufficiently elastic to enable the snapping in of said tip of said post member past said opening and into said cavity.

6. The invention according to claim 5 in which said locking closure means further comprises:

said post member extending from the first end of said interruption of said elongated torus member, having a diameter smaller than the inside diameter of grommets commonly used in the manufacture of shower curtains, said shower curtain being restrained in position by a pair of shoulders formed by said torus member on either side of said post member.

* * * * *